United States Patent [19]

Jones

[11] 4,051,736

[45] Oct. 4, 1977

[54] PUMP JACK

[75] Inventor: Gomer W. Jones, Rose Hill, Kans.

[73] Assignee: Bird Oil Equipment, Ltd., Calgary, Canada

[21] Appl. No.: 648,932

[22] Filed: Jan. 14, 1976

[51] Int. Cl.[2] ..... F16H 21/32

[52] U.S. Cl. ..... 74/41

[58] Field of Search ..... 74/41

[56] References Cited

U.S. PATENT DOCUMENTS

| | | | |
|---|---|---|---|
| 2,170,313 | 8/1939 | Whittlesey | 74/41 |
| 2,997,887 | 8/1961 | Lott | 74/41 |
| 3,405,605 | 10/1968 | Ross | 74/41 |

*Primary Examiner*—Samuel Scott
*Assistant Examiner*—Wesley S. Ratliff, Jr.
*Attorney, Agent, or Firm*—John H. Widdowson; Edwin H. Crabtree

[57] ABSTRACT

A improved pump jack for reciprocating an oil well pump. The improved jack having a unique geometric design wherein the pump includes horizontal push rods for pushing a polish rod load around the radius of a sector head thereby greatly reducing the load on a sampson post and producing a greater mechanical advantage in the raising and lowering of the pump.

5 Claims, 6 Drawing Figures

PUMP JACK

BACKGROUND OF THE INVENTION

This invention relates generally to oil field equipment and more particularly but not by way of limitation to a pump jack for reciprocating an oil well pump.

Heretofore a pump jack of the type having a walking beam rotatably mounted on an "A" frame sampson post has been the standard in the oil industry. At one end of the walking beam is mounted a sector head or commonly called a "horse head." The sector head includes a cable line attached to a polish rod. The polish rod is attached to connected pump rods and a pump inside the well. A polish rod load is the combined weight of the polish rod, pump rods, pump, and the oil being pump to the ground surface. One end of a vertically disposed connecting rod is attached to the other end of the walking beam. The other end of the connecting rod is connected to rotating counterweights. The counterweights are rotated by a speed reduction box driven by a drive motor. Because of the pump jack's inherent design the combined weight of the walking beam, connecting rod, counterweights, and the polish rod load are placed on the sampson post. This combined weight requires the pump jack to be constructed of heavy metal castings including a reinforced base on a suitable foundation in order to carry this heavy load. Also because of the weight of the pump jack additional horsepower requirements are placed on the drive motor for raising and lowering the polish rod load.

In operation the drive motor drives the gear box which rotates the counterweights. The connecting rod attached to the counterweights move the walking beam up and down. As the walking beam moves up and down, the sector head raises and lowers the polish rod, pump rods, and pump. At the peak of the sector head's upstroke or downstroke sufficient time must be given for the string of pump rods to completely move upward or downward. This time period is called lag time and is measured in degrees. Under normal pumping conditions and when the torque load requirements for lifting the polish rod load have been balanced, the counterweights will rotate approximately 175° moving the sector head to the peak of its upstroke. At this point there is an average 5° lag time for the complete string of pump rods to move upward before the counterweights which are continuing to rotate start the sector head on a downstroke. If the 5° lag time is not sufficient time for the entire string of pump rods to complete the upstroke, the downstroke of the sector head will start the string of rods moving downward and the pump rods will snap. Pump rod snap will cause rod shock and excessive wear on the rods and pump. Insufficient lag time causing rod snap is common in deep wells where the combined weight of the string of drill rods will cause the rods to stretch as the rods and pump are raised and lowered.

There have been various departures from the above described pump jack having a walking beam. None of the prior art pump jacks disclose the advantages and unique features of the improved jack as herein described.

SUMMARY OF THE INVENTION

The improved pump jack used horizontal reciprocating push rods attached to the counterweights and the sector head. The horizontal puch rods push the polish rod load around the radius of the sector head thereby relieving the load on the sampson post by over 50%.

This reduction of load on the sampson post allows the combined weight of the improved pump jack to be reduced by over one half thereby reducing the cost of constructing the jack and the cost of shipping the jack to the well site. This reduced weight also allows lower horsepower requirements in balancing the torque load required to lift the polish rod load.

Because of the reduced weight requirements, rectangular tubing can be used thereby eliminating heavy metal castings. The metal tubing also provides the pump jack with high torsional rigidity at minimal weight.

The horizontal push rods, moving the sector head up and down in the raising and lowering of the polish rod load provide a 10° lag time at the top of the upstroke and a 10° lag at the bottom of the downstroke. This lag time is sufficient to eliminate rod shock thereby prolonging rod and pump life.

The improved pump jack includes a horizontal base having counterweights rotatably mounted on the rear thereof. A speed reduction box is mounted on the rear of the base for rotating the counterweights. Connected to the counterweights are horizontal push rods which are attached to a sector head. The sector head is rotatably attached to a sampson post and the push rods. As the push rods reciprocate in a horizontal plane, the sector head is moved up and down thereby raising and lowering the polish rod attached to the deep well pump.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
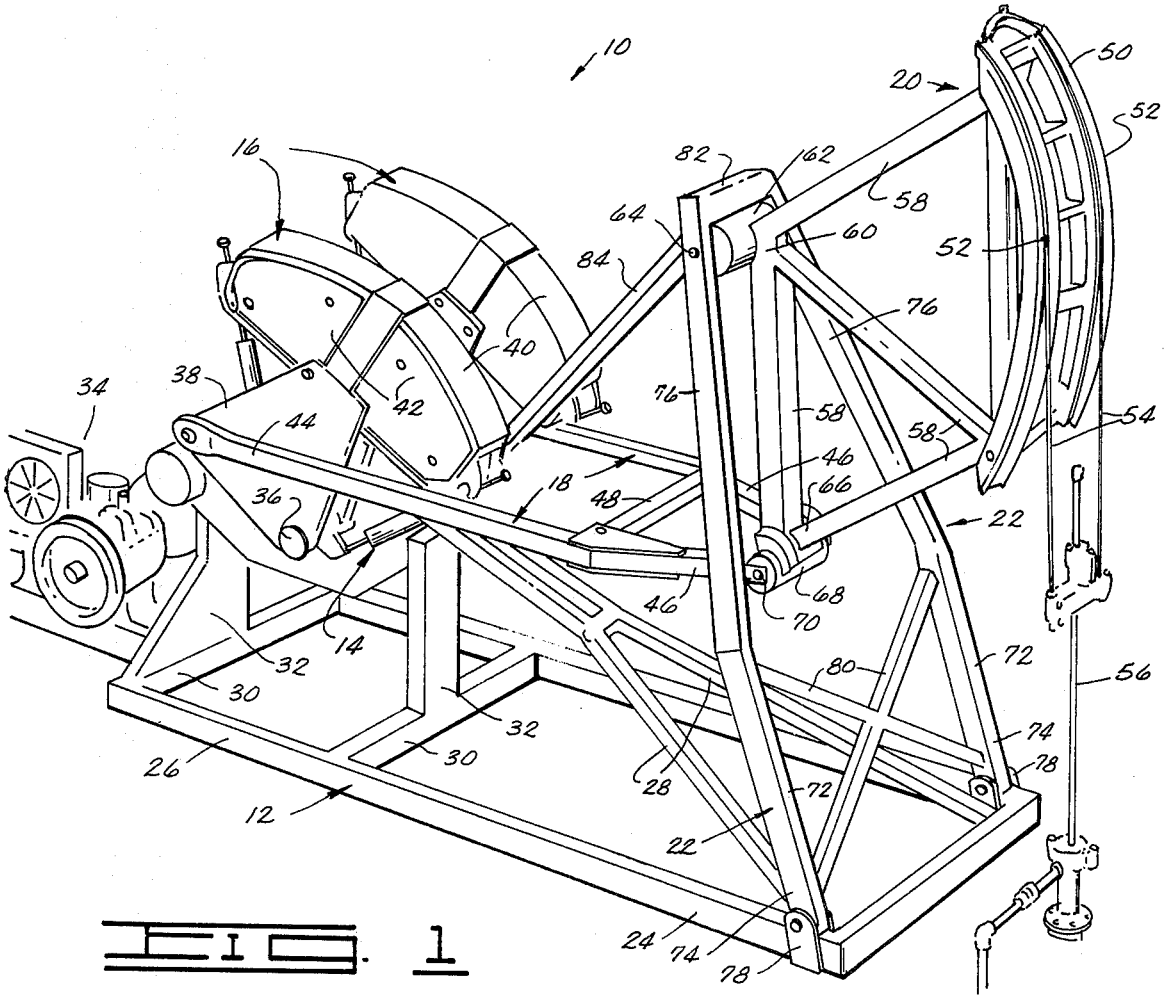
FIG. 1 is a perspective view of the improved pump jack.

In FIG. 1 the improved pump jack is designated by general reference numeral 10. The jack 10 includes a base 12, a speed reduction box 14 mounted on the base 12, counterweights 16 rotatably mounted on each side of the speed reduction box 14, horizontal push rods 18 attached at one end to the counterweights 16 and at the other end to a sector head 20, and an upwardly extending sampson post 22 attached to the base 12 and the sector head 20.

The base 12 includes a front portion 24 and a rear portion 26. The front portion 24 includes angular bracing 28 for providing rigidity to the base 12. The rear portion 26 includes lateral bracing 30 and vertical bracing 32 for supporting the weight of the speed reduction box 14 thereon.

The speed reduction box 14 is driven by a gas engine 34 or any other similar type of drive motor. The gear box 14 includes a drive shaft 36 which is attached to the counterweights 16.

The counterweights 16 include counterweight arms 38 which are attached at one end to the drive shaft 36 and at the other end to counterweight pods 40 containing leaf weights 42 therein.

The push rods 18 include a first end portion 44 and a second end portion 46. The first end portion 44 is attached to the counterweight arms 38. The second end portion 46 of the rods 18 is attached to the sector head 20. The push rods 18 further include lateral bracing 48 for securing the second end portion 46 of the rods 18 together. The push rods 18 are horizontally positioned and parallel to each other.

The sector head 20 includes an annular section 50 having a grooved portion 52 along the sides of the length of the section 50. Attached at the top of the section 50 and riding in the grooved portion 52 is a cable line 54 which is attached to a polish rod 56. The polish rod 56 is connected to the pump rods and pump inside the well. As the sector head 20 is raised and lowered, the polish rod 56 is also raised and lowered thereby reciprocating the pump rods and pump thereby activating the pumping of the oil, gas or the like from the well.

The sector head 20 further includes angular bracing 58 attached to the rear of the annular section 50. The bracing 58 is generally in a trapezoidal configuration with an upper intersection 60 of the bracing 58 rigidly secured to a bearing 62 which is rotatably attached to a bearing shaft 64 secured to the top portion 76 of the sampson post 22. A lower intersection 66 of the bracing 58 is rigidly attached to a bearing 68 which is rotatably mounted on a bearing shaft 70. The bearing shaft 70 is secured to the second end portion 46 of the push rod 18.

The upwardly extending sampson post 22 includes parallel legs 72. The legs 72 include a bottom portion 74 and a top portion 76. The bottom portion 74 of the legs 72 is attached to the front portion 24 of the base 12 by hinge plates 78. The legs 72 are supported together by cross bracing 80. The top portion 76 of the legs 72 is joined together by a cross bar 82. The sampson post 22 is inclined inwardly toward the rear portion 26 of the base 12. The top portion 76 of the sampson post 22 is supported by a stablizing bar 84 attached to the post 22 and the base 12.

Figure 2:
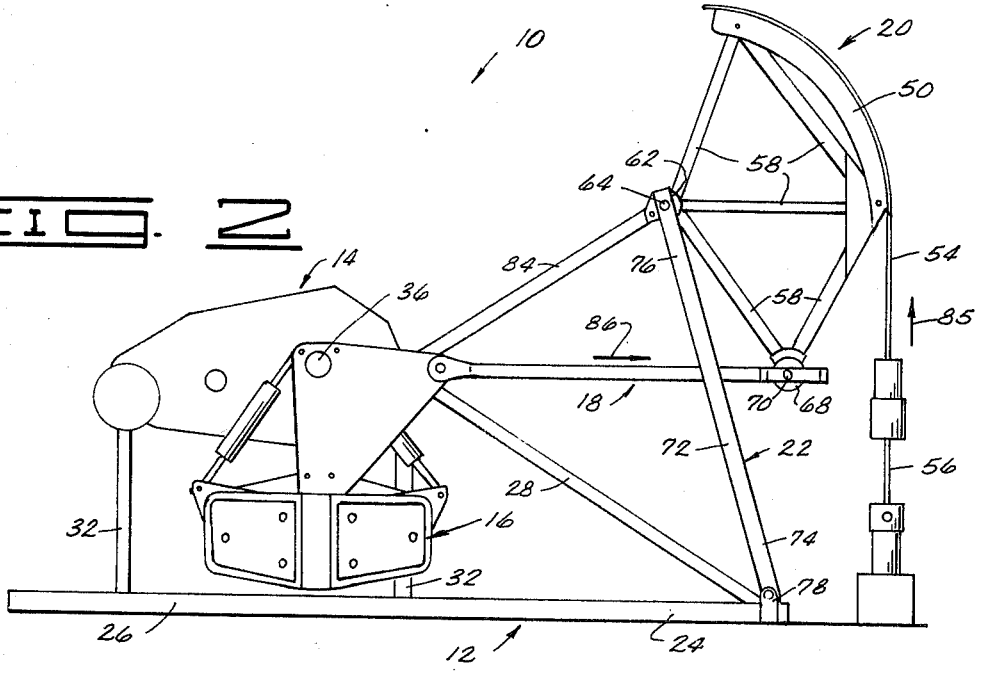
FIG. 2 is a side view of the pump jack with the sector head in an upstroke position.

In FIG. 2 a side view of the improved pump jack 10 can be seen with the sector head 20 in an upward position, as indicated by arrow 85. In this view the counterweights 16 have rotated to a downward position. In this position the counterweights 16 have moved push rods 18 to the right as indicated by arrow 86. As the push rods 18 move to the right the rotatably attached sector head 20 is moved upward rotating about an axis through the center of the bearing shaft 64 attached to the top portion 76 of the sampson post 22. As the sector head 20 moves upward the polish rod load is distributed around the radius of the annular section 50. Because of the geometric design of the jack 10 this load is not only distributed to the sampson post 22 but is also distributed from the trapezoidal bracing 58 to the horizontal push rods 18 thereby reducing the overall load on the sampson post 22. In FIG. 2 the sector head 20 is at the peak of its upstroke. At this position there is a 10° lag time as the push rods 18 reverse their horizontal movement from right to left. This 10° lag time provides sufficient time for the entire length of the pump rods and pump to complete its upward movement. The 10° lag time is particularly important on long pump rod strings which ordinarily would not be given sufficient lag time for the entire pump rod string to complete either its upward or downward movement before the reverse movement begins.

Figure 3:
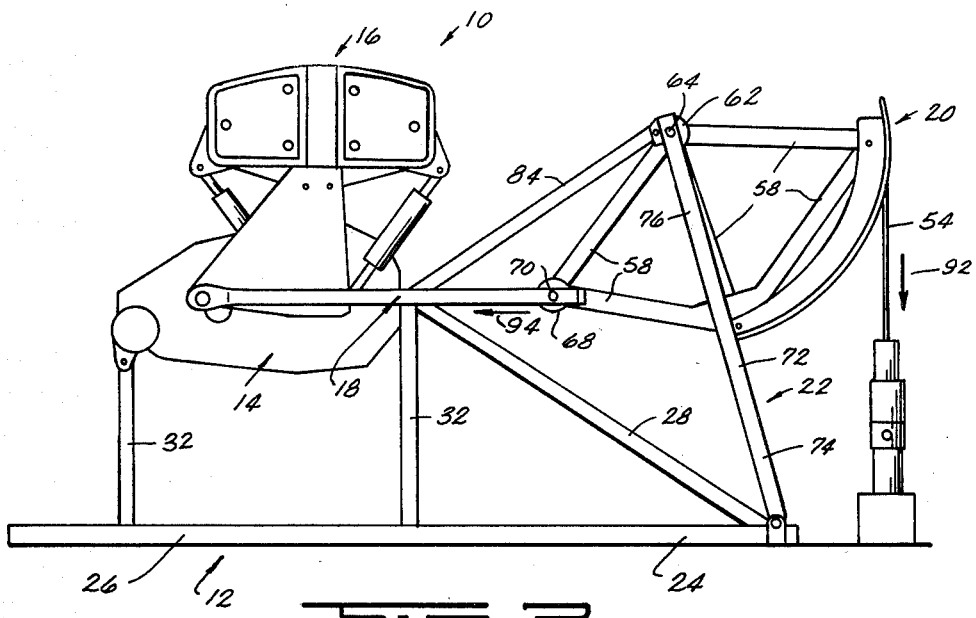
FIG. 3 is a side view of the pump jack with the sector head in a downstroke position.

In FIG. 3 the improved pump jack 10 is shown with the sector head 20 in a downward position as indicated by arrow 92. In this figure the counterweight 16 is in its upward position having moved the push rods 18 to the left as indicated by arrow 94. In FIG. 2 with the sector head 20 in an upward position, the weight of the polish rod load is used to lift the weight of the counterweight 16 in an upward position. In FIG. 3 with the counterweight 16 in an upward position, the weight of the counterweight 16 along with the torque of the drive shaft 36 is used to lift the polish rod load upward. When the sector head 20 is in a downward position there is again a 10° lag time as the push rods 18 reverse their horizontal movement from left to right allowing the length of the pump rods and pump to complete its downward movement.

Figure 4:
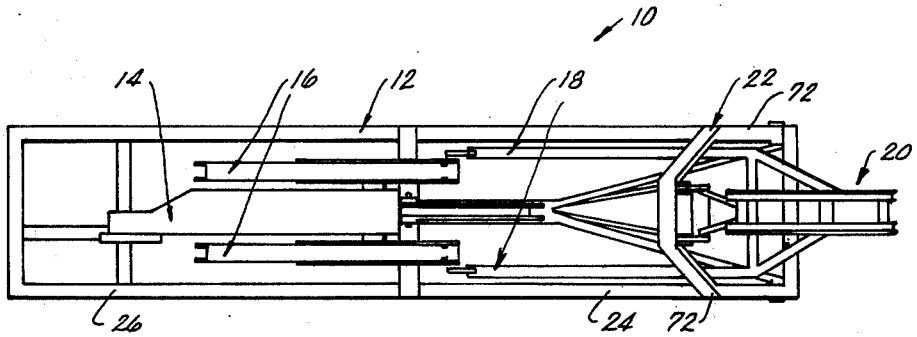
FIG. 4 is a top view of the pump jack.

FIG. 4 is a top view of the pump jack 10. In this view the counterweight 16 can be seen disposed on each side of the speed reduction box 14. Attached to the counterweight arms 38 are the push rods 18. The push rods 18 can be seen positioned between the legs 72 of the sampson post 22 and below the top portion 76 of the sampson post 22.

Figure 5:
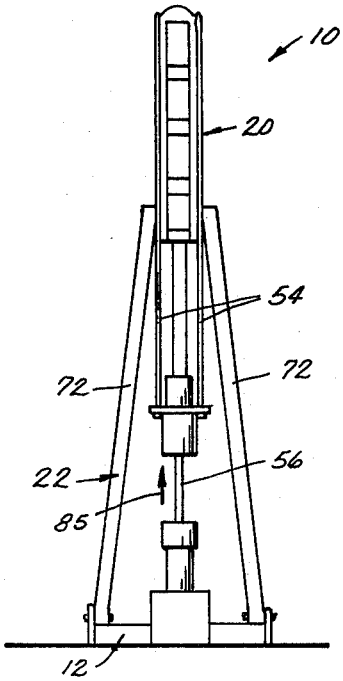
FIG. 5 is a front view of the pump jack.

FIG. 5 is a front view of the pump jack 10 with the sector head 20 in an upward position as indicated by arrow 85 and similar to the position of the sector head 20 shown in FIG. 2.

Figure 6:
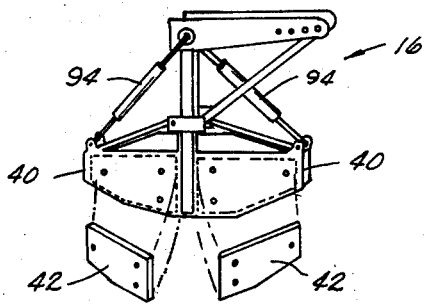
FIG. 6 is a detailed view of the counterweights showing adjustable leaf weights for attaching to the counterweight pods.

FIG. 6 is a front view of the counterweight 16 showing the adjustability of the weight on the counterweight 16 by adding leaf weights 42 to the counterweight pods 40. By adding or removing the leaf weights 42 from the counterweight pods 40 the overall weight of the counterweights 16 can be balanced against the weight of the polish rod load. The counterweight 16 further includes turn buckles 94 for balancing the weight of the counterweight pods 40 on the drive shaft 36.

Changes may be made in the construction and arrangement of the parts or elements of the embodiment as disclosed herein without departing from the spirit or scope of the invention as defined in the following claims.

I claim:

1. An improved pump jack for raising and lowering a polish rod attached to pump rods and a well pump, the jack comprising:

a horizontal base having a front portion and a rear portion;

a pair of counter weights rotatably mounted on the rear portion of said base;

a speed reduction box mounted on the rear portion of said base and disposed between said counter weights and rotatably attached thereto;

an upwardly extending sampson post, said post including a pair of parallel legs, the bottom portion of the legs attached to each side of the front portion of said base, the top portion of the legs secured together;

a pair of horizontal push rods having a first end portion and a second end portion, the first end portion rotatably attached to said counter weights, the second end portion disposed below the top portion of the legs of said post and therebetween; and a sector head having trapazoidal bracing, said bracing rotatably attached to the top portion of the legs of said post and to the second end portion of said push rods, said sector head having an annular section attached to said bracing, said annular section attached to the polish rod for raising and lowering the polish rod thereon, the load on the polish rod is distributed proportionately on said annular section and through said bracing to said push rod and said post;

said push rods reciprocating in a horizontal plane, said push rods on their forward stroke raising said sector head, said push rods on their return stroke lowering said sector head.

2. The improved jack as described in claim 1, wherein said push rods, when reversing direction horizontally, provide a lag time sufficient to allow the polish rod, pump rods and well pump to complete their upward and downward movement.

3. The improved jack as described in claim 1 further including a stabilizer bar having one end attached to the top portion of said post and the other end attached to the rear of said base for helping support the weight on said post.

4. The improved jack as described in claim 1 wherein said counterweights include leaf weights removably mounted in counterweight pods for adjusting the weight of said counterweights.

5. The improved jack as described in claim 1 wherein said sector head includes an annular section having a cable line mounted thereon, the cable line attached to the polish rod, the annular section supported by angular bracing, the angular bracing rotatably attached to said post and said push rods.

* * * * *